US008616394B2

(12) United States Patent
Kim

(10) Patent No.: US 8,616,394 B2
(45) Date of Patent: Dec. 31, 2013

(54) CONTAINER CAP

(75) Inventor: Jeong-seon Kim, Chino Hills, CA (US)

(73) Assignees: Kirin Packaging, Inc.; Polymer Packaging, Inc.

( * ) Notice: Subject to any disclaimer, the term of this patent is extended or adjusted under 35 U.S.C. 154(b) by 3 days.

(21) Appl. No.: 13/346,451

(22) Filed: Jan. 9, 2012

(65) Prior Publication Data

US 2013/0175274 A1 Jul. 11, 2013

(51) Int. Cl.

| | |
|---|---|
| ***B65D 41/00*** | (2006.01) |
| ***B65D 41/04*** | (2006.01) |
| ***B65D 17/40*** | (2006.01) |

(52) U.S. Cl.

USPC ..... 215/305; 215/250; 215/252; 215/295; 220/276; 220/288

(58) Field of Classification Search

USPC ..... 215/252, 253, 256, 295, 305, 250, 334, 215/337; 220/260, 276, 288, 303

See application file for complete search history.

(56) References Cited

U.S. PATENT DOCUMENTS

| | | | | |
|---|---|---|---|---|
| 6,811,047 | B1 * | 11/2004 | Hicks et al. | 215/305 |
| D579,332 | S * | 10/2008 | Krivoshein | D9/453 |
| 8,443,999 | B1 * | 5/2013 | Reinders | 220/303 |
| 2003/0062329 | A1 * | 4/2003 | Alley | 215/307 |

* cited by examiner

*Primary Examiner* — Anthony Stashick
*Assistant Examiner* — Madison L Poos
(74) *Attorney, Agent, or Firm* — John K. Park; Park Law Firm

(57) ABSTRACT

An aspect of the invention provides a container cap. The container cap comprises a cap, a handling outer portion, and connecting walls. The cap has a closed end and an open end. The handling outer portion encloses the cap and including recesses and a plurality of protrusions. The plurality of connecting walls connect an outer wall of the cap and an inner wall of the handling outer portion, wherein the connecting walls are disposed radially. The voids are provided between the outer wall of the cap, the inner wall of the holding outer portion, and the connecting walls.

16 Claims, 6 Drawing Sheets

CONTAINER CAP

BACKGROUND OF THE INVENTION

The present invention relates to a container cap. More particularly, this invention relates to a container cap, which has a convenient structure for sealing and handling a container.

Accordingly, a need for a container cap has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a container cap.

Another object of the invention is to provide a container cap, which seals container conveniently.

Still another object of the invention is to provide a container cap, which is easy to handle.

An aspect of the invention provides a container cap.

The container cap comprises a cap, a handling outer portion, and a plurality of connecting walls.

The cap has a closed end and an open end.

The handling outer portion encloses the cap and including a plurality of recesses and a plurality of protrusions.

The plurality of connecting walls connect an outer wall of the cap and an inner wall of the handling outer portion, wherein the connecting walls are disposed radially.

A plurality of voids are provided between the outer wall of the cap, the inner wall of the holding outer portion, and the connecting walls.

The cap and the female thread may be configured to fit into and seal an opening of a container.

The container cap may further comprise a female thread provided on inner wall of the cap, and the female thread may be configured to fit to a male thread of the opening of a container.

The container cap may further comprise a safety seal provided at the open end of the cap, and the safety seal may be configured to hold the opening of the container in place for a twisting force below a predetermined magnitude and break for a twisting force above the predetermined magnitude.

The handling outer portion may comprise three or more recesses and three or more protrusions, and the recesses and the protrusions may be disposed alternatingly.

The recesses and the protrusions may form a circular shape with six indentations, and the circular shape may form an overall appearance of a shape of six petal flower.

Then there may be three connecting walls, and they may extend radially from inner walls of three every other recesses.

Each of the connecting walls may extend vertically from a first position below a top edge of the handling outer portion by a first predetermined distance to a second position above a bottom edge of the handling outer portion by a second predetermined distance.

At least one of the recesses may comprise one or more first through-holes.

At least one of the protrusions may comprise one or more second through-holes.

One of the through-holes may have a shape of circle.

One of the connecting walls may comprise one or more third through-holes.

The third through-hole may have a shape of circle.

The cap, the handling outer portion, and the plurality of connecting walls may be formed integrally.

The safety seal may be formed integrally.

The safety seal may protrude below a plane defined by the lower end of the handling outer portion.

The cap may be cylindrical, but is not limited.

A gap may be provided between the lower side of the cap and the upper side of the safety seal in which an abutment flange of a container fits in.

The inner safety seal wall may be configured to engage at least one protrusion of the container.

The outer diameter of the abutment flange between the lower wall of the cap and the upper wall of the safety seal may be larger than the inner diameter of the safety seal.

The advantages of the present invention are: (1) the container cap provides a safe sealing; and (2) the container cap provides a sealing means to handle.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 9:
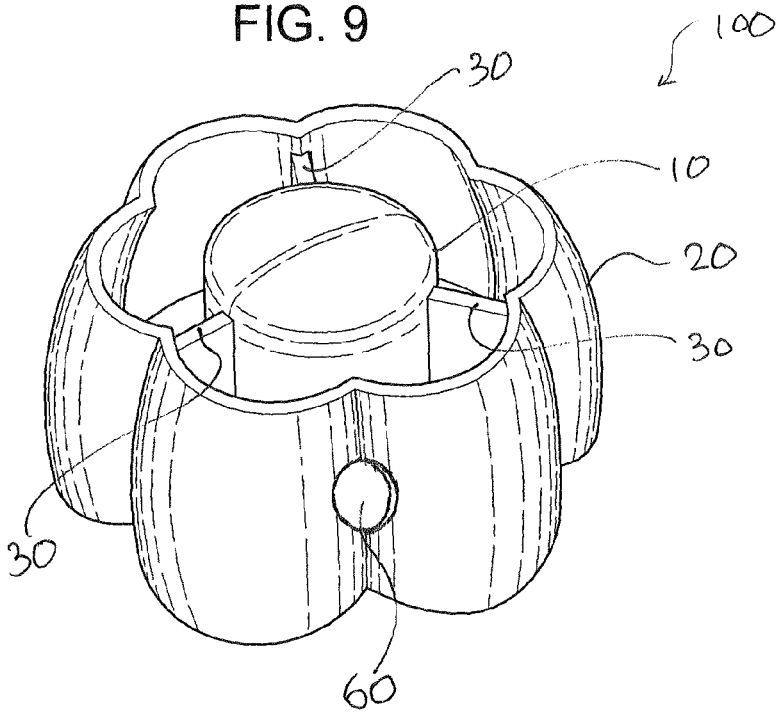
FIG. 9 is a perspective view showing a container cap according to another embodiment of the present invention.
Figure 10:
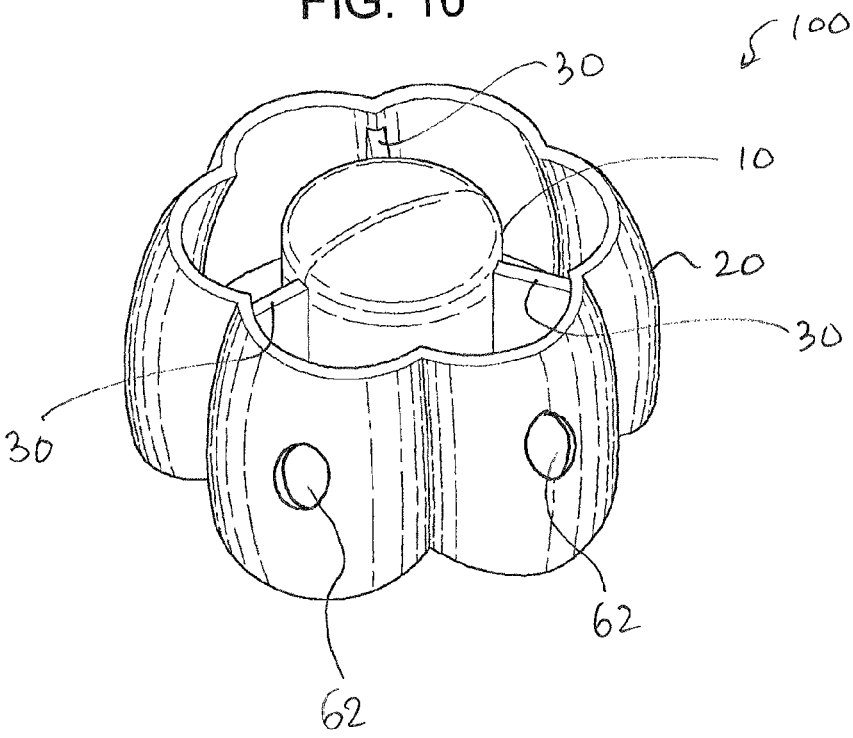
FIG. 10 is a perspective view showing a container cap according to still another embodiment of the present invention.
Figure 11:
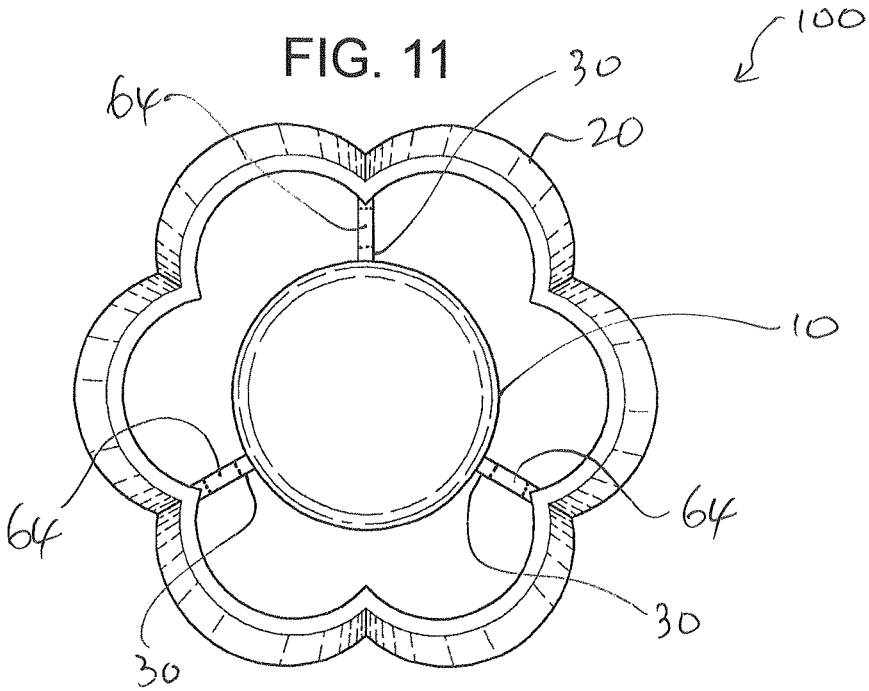
FIG. 11 is a perspective view showing a container cap according to still another embodiment of the present invention.

FIGS. 1-8 show a container cap 100 according to an embodiment of the present invention. FIGS. 9-11 show a container cap according to another embodiment of the present invention.

An aspect of the invention provides a container cap 100.

The container cap 100 comprises a cap 10, a handling outer portion 20, and a plurality of connecting walls 30.

Figure 8:
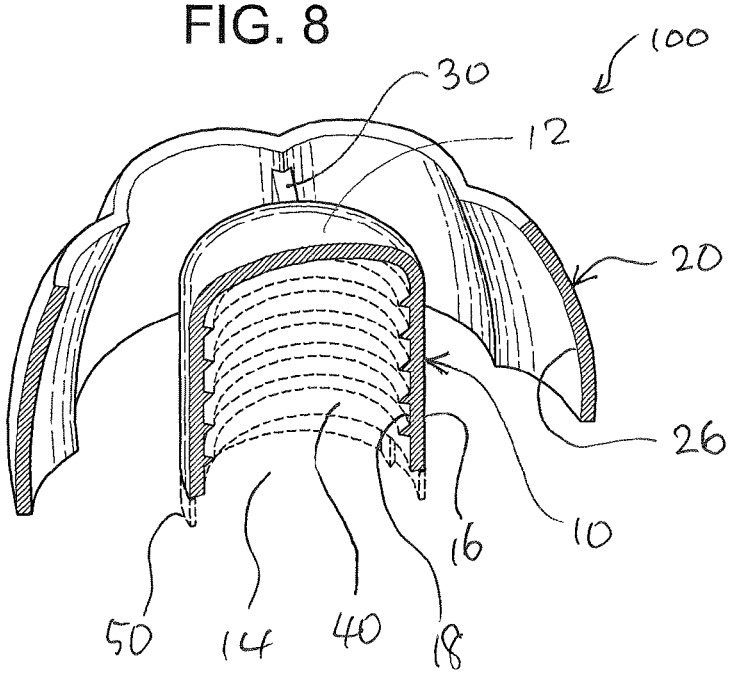
FIG. 8 is a perspective partially cross-sectional view thereof with half cutout.

The cap 10 has a closed end 12 and an open end 14 as shown in FIG. 8.

Figure 6:
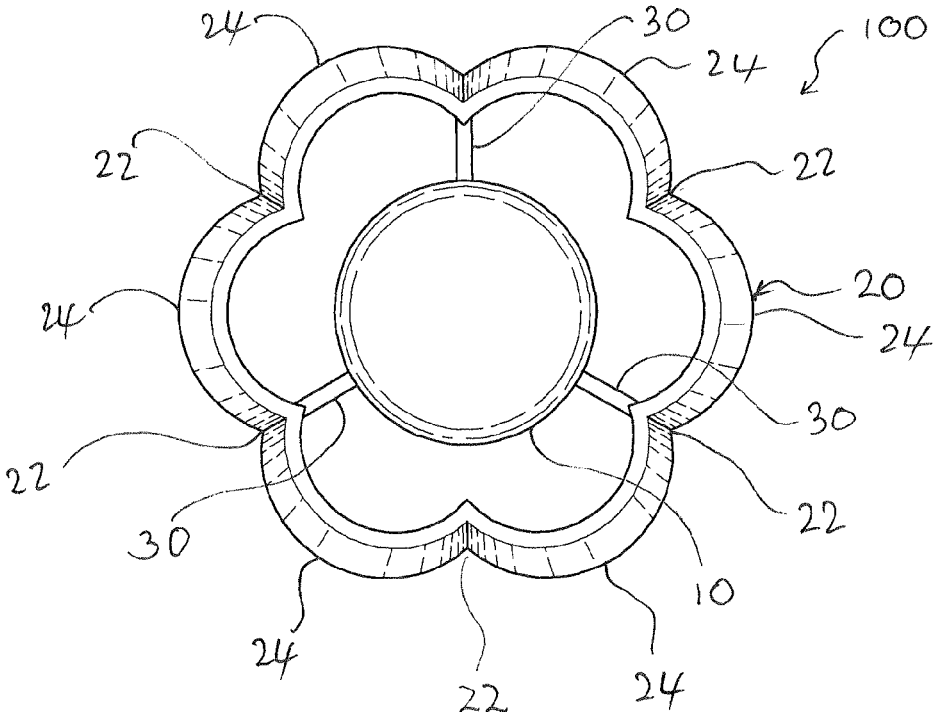
FIG. 6 is a top plan view thereof.

The handling outer portion 20 encloses the cap 10 and includes a plurality of recesses 22 and a plurality of protrusions 24 as shown in FIG. 6.

Figure 7:
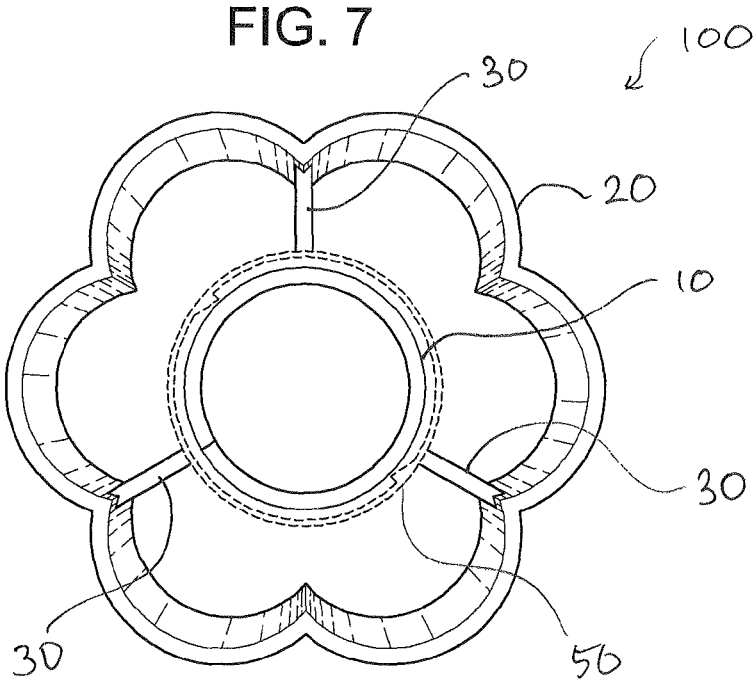
FIG. 7 is a bottom plan view thereof.

The plurality of connecting walls 30 connect an outer wall 16 of the cap 10 and an inner wall 26 of the handling outer portion 20, wherein the connecting walls 30 are disposed radially as shown in FIGS. 6-8.

A plurality of voids are provided between the outer wall 16 of the cap 10, the inner wall 26 of the holding outer portion 20, and the connecting walls 30.

The container cap 100 may further comprise a female thread 40 provided on inner wall 18 of the cap 10. The cap 10 and the female thread 40 may be configured to fit into and seal an opening of a container (not shown) as shown in FIG. 8.

The female thread 40 may be configured to fit to a male thread (not shown) of the opening of the container.

The container cap 100 may further comprise a safety seal 50 provided at the open end 12 of the cap 10 as shown in FIGS. 3, 5, 7, and 8, and the safety seal 50 may be configured to hold the opening of the container in place for a twisting force below a predetermined magnitude and break for a twisting force above the predetermined magnitude.

Figure 1:
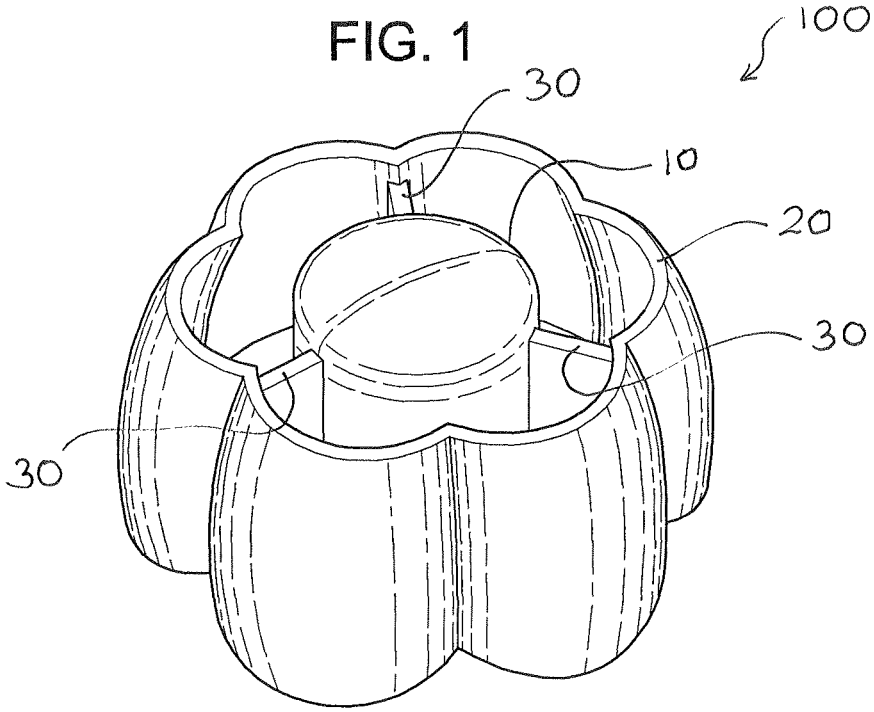
FIG. 1 is a perspective view showing a container cap according to an embodiment of the present invention.
Figure 2:
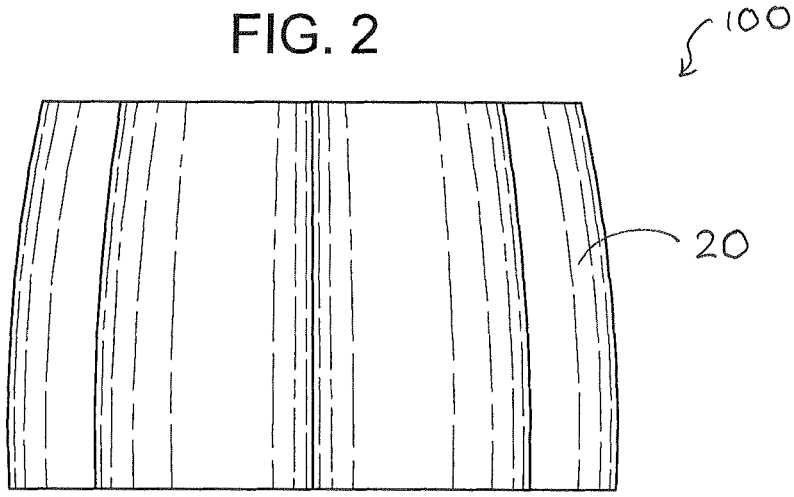
FIG. 2 is a front plan view thereof.

The handling outer portion 20 may comprise three or more recesses 22 and three or more protrusions 24, and the recesses 22 and the protrusions 24 may be disposed alternatingly as shown in FIGS. 1, 6, and 7.

The recesses 22 and the protrusions 24 may form a circular shape with six indentations, and the circular shape may form an overall appearance of a shape of six petal flower as shown in FIGS. 1, 6, and 7.

Then there may be three connecting walls 30, and they may extend radially from inner walls of three every other recesses 22 as shown in FIGS. 6 and 7.

Each of the connecting walls 30 may extend vertically from a first position below a top edge of the handling outer portion 20 by a first predetermined distance to a second position above a bottom edge of the handling outer portion 20 by a second predetermined distance. These first and second predetermined distances may be adjusted to facilitate manufacturing, using, and maintaining of the container cap 100.

At least one of the recesses 22 may comprise one or more first through-holes 60 as shown in FIG. 9.

At least one of the protrusions 24 may comprise one or more second through-holes 62 as shown in FIG. 10.

One of the through-holes 60, 62 may have a shape of circle.

One of the connecting walls 30 may comprise one or more third through-holes 64 as shown in FIG. 11.

The third through-hole 64 may have a shape of circle.

The cap 10, the handling outer portion 20, and the plurality of connecting walls 30 may be formed integrally.

The safety seal 50 may be formed integrally with the cap 10, the handling outer portion 20, and the plurality of connecting walls 30.

Figure 3:
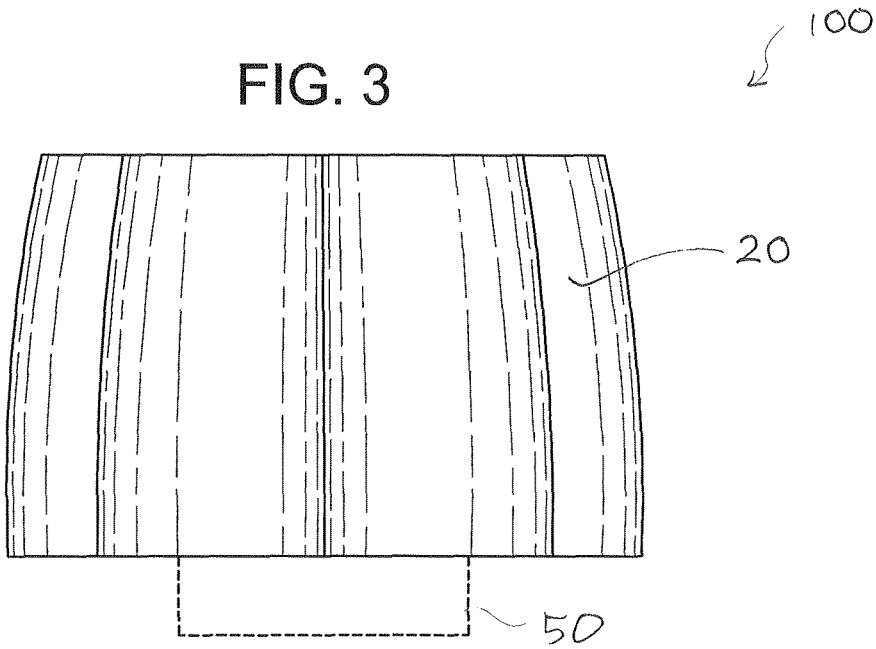
FIG. 3 is a front plan view of a container cap showing my new design.
Figure 4:
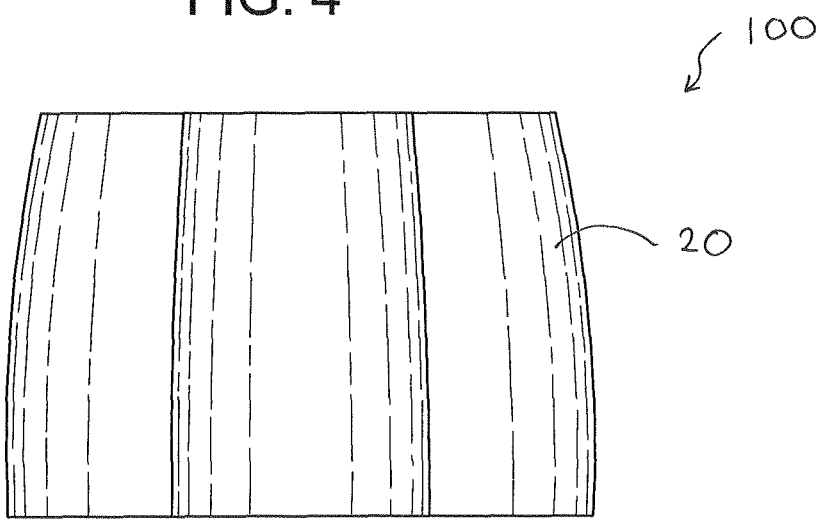
FIG. 4 is a rear plan view thereof.
Figure 5:
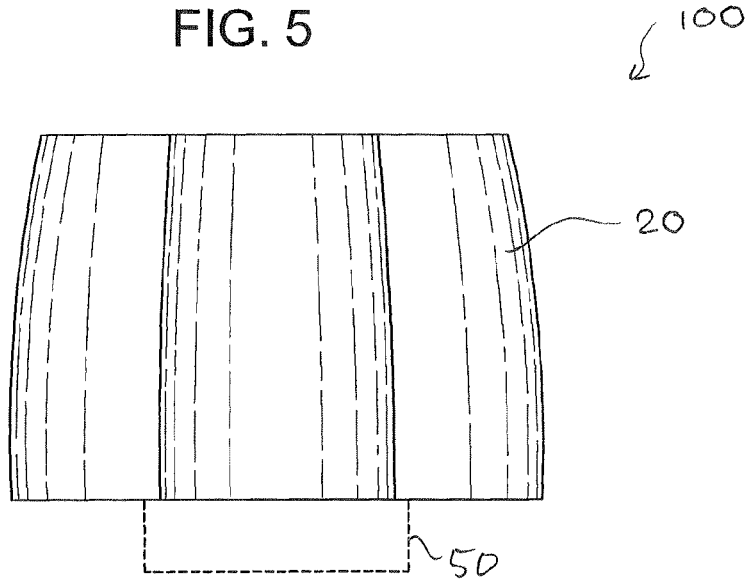
FIG. 5 is a side plan view thereof.

The safety seal 50 may protrude below a plane defined by the lower end of the handling outer portion 20 as shown in FIGS. 3, 5, and 8.

The cap 10 may be cylindrical, but is not limited to that shape.

A gap may be provided between the lower side of the cap 10 and the upper side of the safety seal 50 in which an abutment flange of the container fits in.

The inner safety seal wall may be configured to engage at least one protrusion of the container (not shown).

The outer diameter of the abutment flange between the lower wall of the cap 10 and the upper wall of the safety seal 50 may be larger than the inner diameter of the safety seal 50.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A container cap comprising:

a cap having a closed end and an open end;

a handling outer portion enclosing the cap and including a plurality of recesses and a plurality of protrusions; and a plurality of connecting walls connecting an outer wall of the cap and an inner wall of the handling outer portion, wherein the connecting walls are disposed radially, wherein a plurality of voids are provided between the outer wall of the cap, the inner wall of the holding outer portion, and the connecting walls, wherein at least one of the recesses comprises one or more first through-holes, wherein at least one of the protrusions comprises one or more second through-holes, wherein one of the connecting walls comprises one or more third through-holes.

2. The container cap of claim 1, further comprising a female thread provided on inner wall of the cap, wherein the cap and the female thread are configured to fit into and seal an opening of a container.

3. The container cap of claim 2, wherein the female thread is configured to fit to a male thread of the opening of a container.

4. The container cap of claim 3, further comprising a safety seal provided at the open end of the cap, wherein the safety seal is configured to hold the opening of the container in place for a twisting force below a predetermined magnitude and break for a twisting force above the predetermined magnitude.

5. The container cap of claim 4, wherein the cap, the handling outer portion, and the plurality of connecting walls are formed integrally.

6. The container cap of claim 5, wherein the safety seal is formed integrally.

7. The container cap of claim 6, wherein the safety seal protrudes below a plane defined by a lower end of the handling outer portion.

8. The container cap of claim 4, wherein an inner safety seal wall is configured to engage at least one protrusion of the container.

9. The container cap of claim 8, wherein an outer diameter of an abutment flange between a lower wall of the cap and an upper wall of the safety seal is larger than an inner diameter of the safety seal.

10. The container cap of claim 1, wherein the handling outer portion comprises three or more recesses and three or more protrusions, wherein the recesses and the protrusions are disposed alternatingly.

11. The container cap of claim 10, wherein the recesses and the protrusions form a circular shape with six indentations, wherein the circular shape forms an overall appearance of a shape of six petal flower.

12. The container cap of claim 11, wherein three connecting walls extend radially from inner walls of three every other recesses.

13. The container cap of claim 12, wherein each of the connecting walls extends vertically from a first position below a top edge of the handling outer portion by a first predetermined distance to a second position above a bottom edge of the handling outer portion by a second predetermined distance.

14. The container cap of claim 1, wherein one of the through-holes has a shape of circle.

15. The container cap of claim 1, wherein the third through-hole has a shape of circle.

16. The container cap of claim 1, wherein the cap is cylindrical.

* * * * *